US005884979A

United States Patent [19]

Latham

[11] Patent Number: 5,884,979

[45] Date of Patent: Mar. 23, 1999

[54] CUTTING BIT HOLDER AND SUPPORT SURFACE

[75] Inventor: Winchester E. Latham, Indianapolis, Ind.

[73] Assignee: Keystone Engineering & Manufacturing Corporation, Indianapolis, Ind.

[21] Appl. No.: 840,874

[22] Filed: Apr. 17, 1997

[51] Int. Cl.[6] ..... E21C 35/19

[52] U.S. Cl. ..... 299/106; 299/87.1

[58] Field of Search ..... 299/39.8, 87.1, 299/106, 108

[56] References Cited

U.S. PATENT DOCUMENTS

| | | | |
|---|---|---|---|
| 3,847,439 | 11/1974 | Allen | 299/81.1 |
| 4,006,936 | 2/1977 | Crabiel | 299/39.8 |
| 4,139,318 | 2/1979 | Jakob et al. | 404/90 |
| 4,268,089 | 5/1981 | Spence et al. | 299/87.1 |
| 4,311,284 | 1/1982 | Ratcliff, Jr. | 241/191 |
| 4,325,580 | 4/1982 | Swisher, Jr. et al. | 299/39.8 |
| 4,480,873 | 11/1984 | Latham | 299/81.1 |
| 4,637,753 | 1/1987 | Swisher, Jr. | 404/90 |
| 4,697,850 | 10/1987 | Tuneblom | 299/87.1 |
| 5,052,757 | 10/1991 | Latham | 299/87.1 |
| 5,098,167 | 3/1992 | Latham | 299/104 |
| 5,683,144 | 11/1997 | Kammerer et al. | 299/106 |

FOREIGN PATENT DOCUMENTS

| | | | |
|---|---|---|---|
| 628458 | 5/1963 | Belgium | 299/106 |
| 2442348 | 3/1976 | Germany | 299/108 |

*Primary Examiner*—David J. Bagnell
*Attorney, Agent, or Firm*—Locke Reynolds

[57] ABSTRACT

Cutting bit holding elements removably receiving cutting bits are secured to a cutting assembly used in a roadway surface reclaiming machine. The cutting assembly includes a driven member having a surface, typically cylindrical, rotatable in a cutting direction. The surface includes a plurality of recesses arranged in a preselected pattern, each recess being defined by a generally circular upper edge and including a bottom surface depressed below the driven member rotatable surface. Each cutting bit holding element has a body portion having at least one aperture receiving the cutting bit and a lower portion having a generally cylindrical outer surface sized to be received in only one of said recesses The lower portion has a reference lower end abutting the recess bottom surface with a locating element engaging the cutting bit holder element lower end with a niche within said recess for orienting the cutting bit holder with respect to said cutting direction. An edge of the cutting bit holding element is sized to be proximal to the recess circular upper edge to permit fixed attachment of the body portion to the driven member rotatable surface at a location spaced away for the reference lower end so that, upon replacement of the cutting bit holding element, the reference surface and locating element receiving niche remain undisturbed to ensure proper alignment of replacement structure.

24 Claims, 3 Drawing Sheets

CUTTING BIT HOLDER AND SUPPORT SURFACE

BACKGROUND OF THE INVENTION

The present invention relates generally to rotary driven cutters and scarifiers for use in earth working, mining, and other in situ disintegration of hard materials. The invention is particularly directed to cutting bit holders which are fixed to a surface portion of a rotary driven member such as a cylindrical drum and has particular utility in connection with roadway planing machines, also known as roadway surface reclaiming machines, which are employed prior to roadway resurfacing.

Typical roadway surface reclaiming machines disclosed in the prior art include rotary driven cylindrical drums to which are fixed holders holding one or more cutting bits which scarify and mine the top portion of an asphaltic road surface. While several styles of drums have been employed, at least some styles have included an array of cutting bit holders fixed usually by a peripheral weld to the drum surface. Replaceable cutting bits are received within the cutting bit holders which can be periodically replaced as needed depending upon the amount of wear suffered as a result of the road surface mining operation. Examples of prior art cutting bit holders are to be found in U.S. Pat. Nos. 5,582,468 and 5,098,167, as well as the prior art cited therein.

During the operation of such roadway surface reclaiming machines, a cutting bit and/or a cutting bit holder may strike a particularly hard portion of the road surface in such a way to cause significant damage to the cutting bit holder. The shearing forces in such a situation can be sufficient to shear part or all of one or more of the cutting bit holders from the surface of the rotary driven drum or other driven member thus mandating an immediate replacement of the lost or damaged holders in the field by welding new cutting bit holders to the drum surface. Such a replacement requires that the surface of the drum be prepared to receive the replacement cutting bit holder and can include using a cutting torch to remove any remaining portion of a cutting bit holder as well as a hand held grinder to grind away any residual portion of the weld which held the damaged cutting bit holder to the surface.

Such drum surface preparation is rarely completely satisfactory and generally leaves a roughened surface to which the new cutting bit holder is to be applied. The roughness of the drum surface often prevents the correct alignment of the new cutting bit holder and as a result further damage to the replacement cutting bit holder or other holders adjacent to or aligned with the replaced cutting bit holder are increasing susceptible to accelerated wear and potential damage. Even small changes in alignment of a cutting bit holder of a few degrees can also contribute to substantially accelerated wear of the cutting bits which are removably inserted into the cutting bit holders.

Thus, an object of the present invention is to provide a cutting bit holder and a drum surface adapted to receive a cutting bit holder which is designed to preserve a reference surface engaged by the cutting bit holder, but protected from alteration during replacement of the cutting bit holder, to assure proper alignment of the replacement structure. An additional objection of the present invention is to provide a cutting bit holding element which is designed for field replacement, yet will maintain the originally designed alignment of the cutting bit with respect to the drum assembly as a whole.

SUMMARY OF THE INVENTION

In accordance with the present invention, a cutting assembly for use in a roadway surface reclaiming machine includes a driven member, such as a cylindrical drum, having a surface rotatable in a cutting direction. A plurality of recesses are arranged in a pre-selected pattern over the driven member surface with each recess being defined by a generally circular upper edge and including a bottom surface which is depressed below the driven member rotatable surface. A cutting bit holding element of the present invention includes a lower end to be received in only one of the recesses with the lower end of the cutting bit holder element abutting the recess bottom surface. The bottom surface of the recess and the lower end surface of the cutting bit holding element are preferably complementary to maximize the surface contact when the cutting bit holder element lower end is situated in abutting relationship with the recess bottom reference surface.

Each cutting bit holding element has an edge proximal to the recessed circular upper edge which preferably includes a flange projecting outwardly to cover the recess circular upper edge. A locating element is engaged between each recess and the cutting bit holding element situated within that recess for orienting the holder element with respect to the cutting direction. The locating element preferably takes the form of a key or pin projecting downward from the bottom surface of the cutting bit holding element which is received within a niche present in the recess bottom surface. The cutting bit holding element is secured to the driven member surface by a weld line joining a region immediately surrounding the circular upper edge to the cutting bit holding element. A cutting bit can be releasably secured in the cutting bit holding element.

In many rotary driven cylindrical cutters, the individual cutting bits can be aligned in a known manner to maximize the mining activity and facilitate removal of mine material from the kerf created by the cutting operation. In certain alignment regimens, cutting bit holding elements on one side of the drum are aligned differently than cutting bit holding elements on the opposite side of the drum. When such a regimen is employed in connection with the present invention, the niche or other feature in each recess bottom reference surface can be appropriately displaced to one side or another to allow use of a single type of cutting bit holding element at all positions on the drum, the difference in alignment being achieved through the location of the alignment niche within the recesses. Alternatively, the niches can be of a unique confirmation or located in a unique location so that only a cutting bit holding element having a cutting bit with the desired left or right threading can be received at each particular location on the drum surface.

In one embodiment of the present invention, discrete support elements are inserted between the drum surface and the cutting bit holding elements, the support elements constituting flighting segments weldable together to form a substantially continuous flighting. The pattern and arrangement of the support elements is subject to variation, but in a preferred embodiment the pattern follows my co-pending U.S. patent application Ser. No. 08/805,145 filed Feb. 24, 1997, the specification of which is hereby incorporated by reference. Each discrete support element or flighting segment preferably includes a lower end to be received in only one of the drum recesses with the lower end of the discrete support element abutting the recess bottom surface in the manner previously described with respect to the cutting bit holder element lower end. The upper end of each discrete support element includes a recess defined by a generally circular upper edge and including a bottom surface which is depressed below the discrete support element upper end. A cutting bit holding element of the present invention is received in the support element upper end recess and secured in position as described previously.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures.

DESCRIPTION OF THE PREFERRED EMBODIMENT

Figure 1:
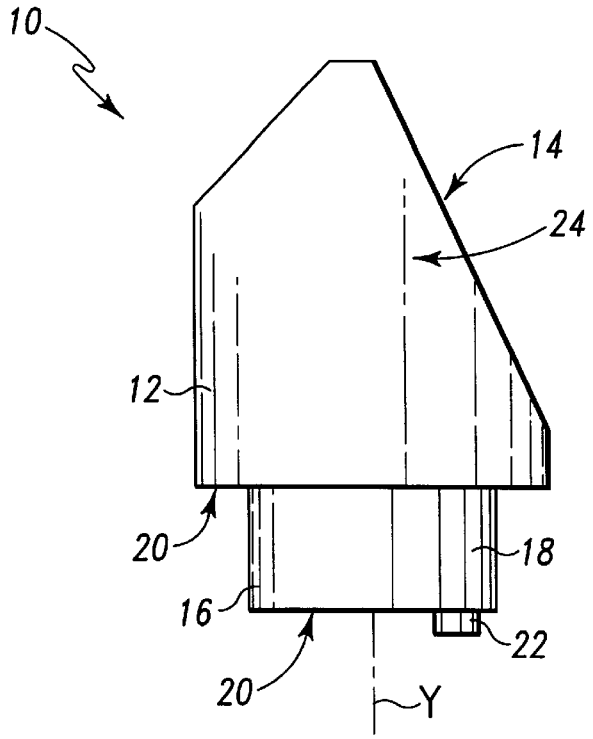
FIG. 1 is a side elevation view of a cutting bit holding element of the present invention.
Figure 2:
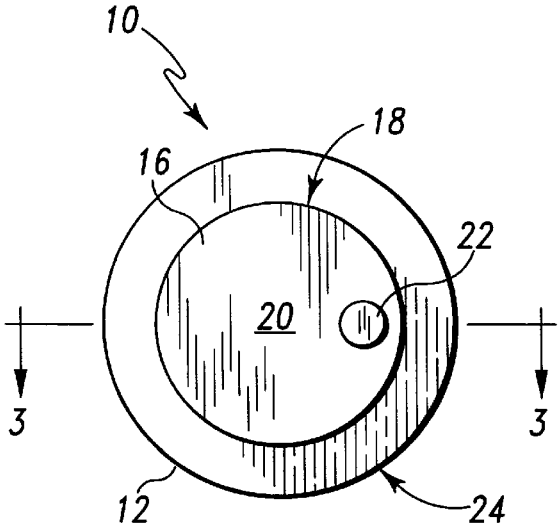
FIG.2 is a bottom plan view of the cutting bit holding element shown in FIG. 1.
Figure 3:
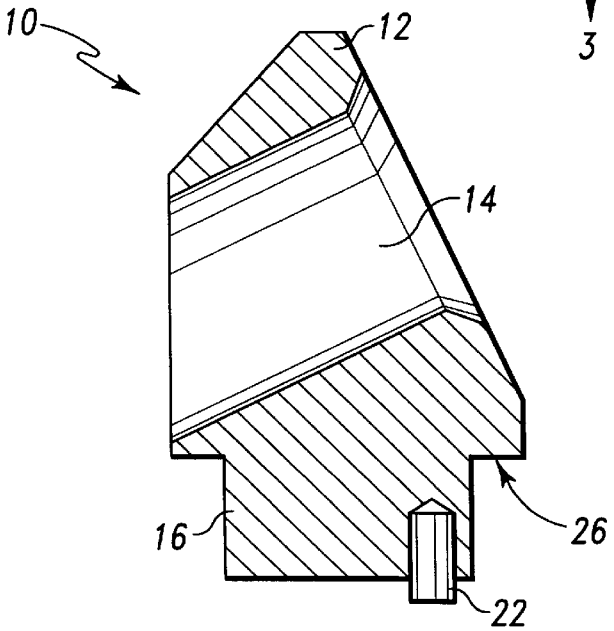
FIG. 3 is a sectional view of the cutting bit holding element of FIGS. 1 and 2 taken along line 3—3.
Figure 4:
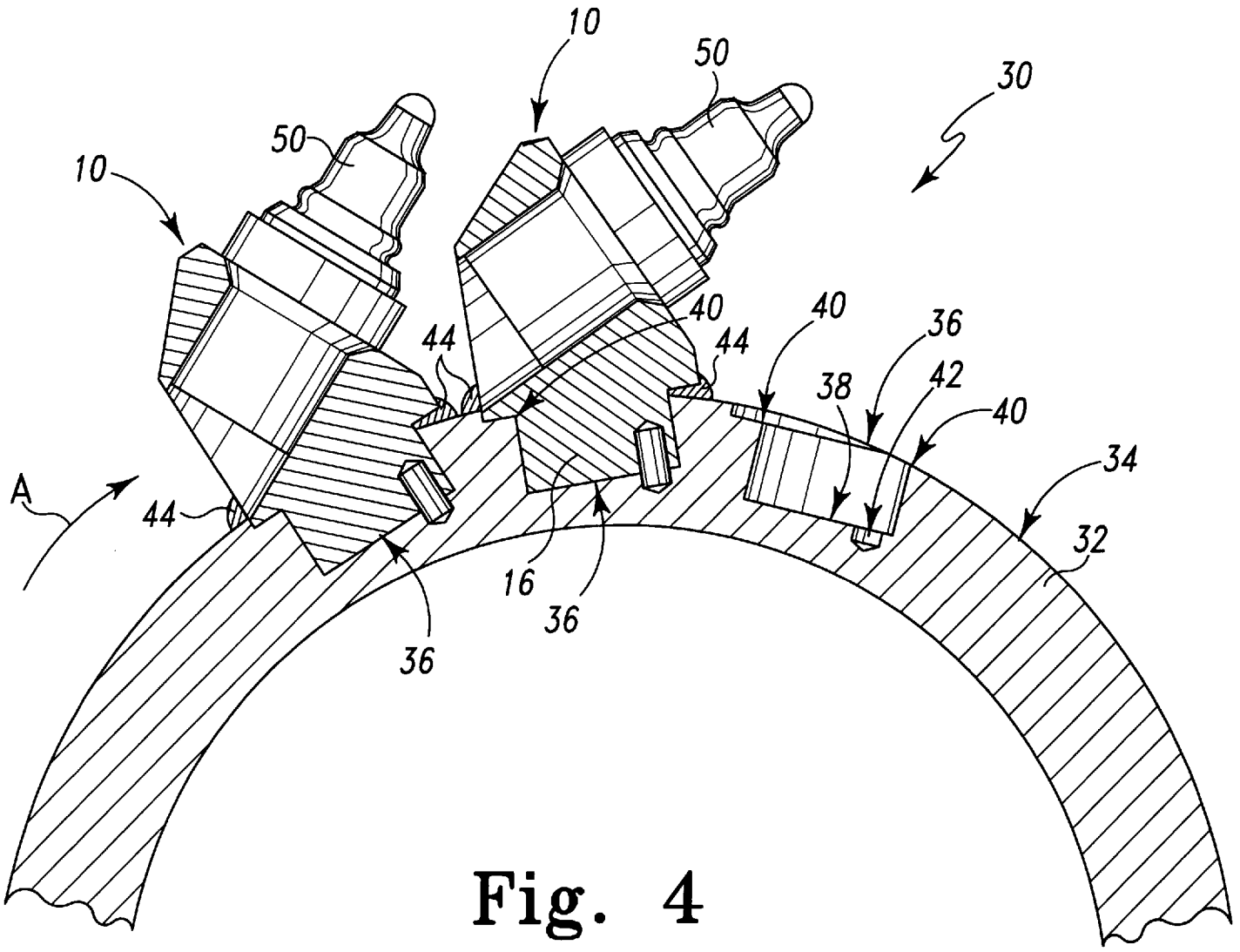
FIG. 4 is a sectional view of a cutting assembly of the present invention.
Figure 5:
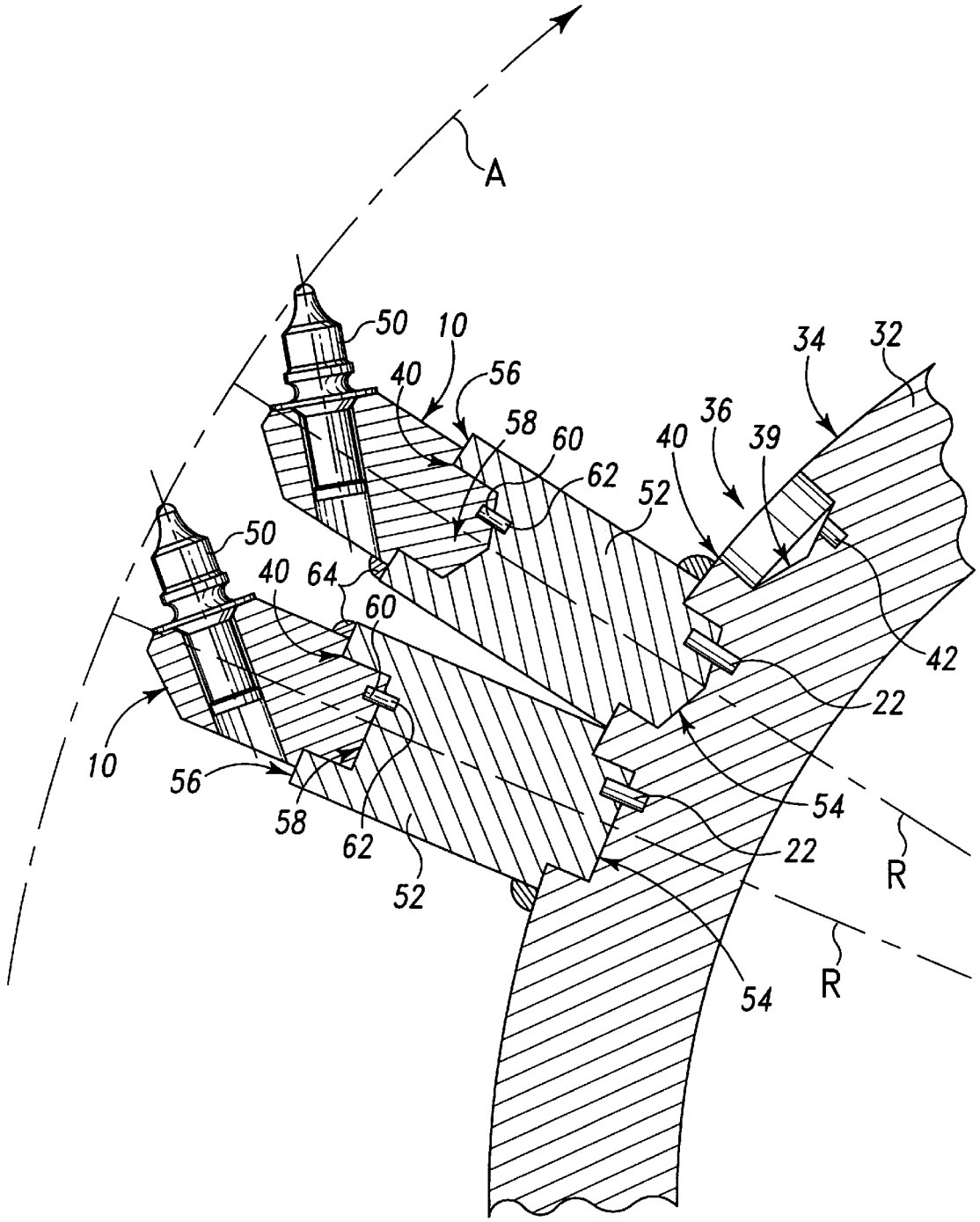
FIG. 5 is a sectional view of another embodiment of the invention wherein discrete support elements which can form flighting segments are inserted between the drum surface and the cutting bit holding elements, the support elements being weldable together to form a substantially continuous flighting.

A cutting bit holding element 10 of the present invention is shown in FIGS. 1–3 to include a body portion 12 which includes an aperture 14 for removably receiving a cutting bit as shown in FIGS. 4 and 5. The cutting bit holding element 10 includes a lower portion 16 having a generally cylindrical outer surface 1 8 and a planar bottom surface 20. A locating element 22 in the form of a round dowel pin projects downwardly from the bottom surface 20. The locating element 22 is purposefully located off of the axis of the rotation of surface 18 so that the alignment achieved with the locating element 22 is uniquely defined. While the outer surface 24 of body portion 12 is also illustrated in FIG. 1 and 2 to be generally cylindrical, the shape of surface 24 is subject to design change. A flange 26 projects outwardly from surface 18 to surface 24. The size and shape of the flange 26 is related directly to the choice of design for the outer surface 24.

A cutting assembly 30, in accordance with the present invention, is shown in FIG. 4 and includes a driven member 32 having an outer surface 34 which is rotatable in a cutting direction, arrow A. The driven member 32 includes a plurality of recesses 36, two of which are shown receiving a cutting bit holding element 10 as shown in FIGS. 1–3 including replaceable cutting bits 50, shown in phantom. Each recess 36 includes a bottom reference surface 38 which is depressed below the driven member rotatable surface 34. The bottom reference surface 38 of each recess 36 and the lower end surface 20 of the cutting bit holding element 10 are preferably complementary to maximize surface contact when the cutting bit holder lower end is situated in abutting relationship with the recess bottom reference surface. While the surfaces 20 and 38 are illustrated to be planar, the surfaces could also be conical, spherical, or some other shape symmetric with respect to surface 18. Each recess 36 also includes a generally circular upper edge 40 and a niche 42 shown located in bottom surface 38 to receive the locating element 22. It will be appreciated that the niche 42 should be complementary to the locating element 22 to uniquely position and align the bottom portion 16 of the cutting bit holding element within the recess 36. The location of the niche 42 in the bottom surface 38 determines the alignment of the cutting bit holder 10 with respect to the cutting direction, arrow A.

When the cutting bit holding elements 10 are situated within the recesses 36, as shown in FIG. 4, they are secured in position by means of a weld line 44 joining the cutting bit holding element to the surface 34 in a line outside of the upper edge 40 of each recess 36. Thus while the cutting assembly is in use mining the roadway or other surface, the bottom reference surface 38 of recess 36 is protected from abrasion or wear. In the event of wear or catastrophic failure of one or more of the cutting bit holding elements 10, the worn or failed element is removed from the assembly usually by removing the weld line 44. Such removal may affect a portion of the outer surface 34 immediately surrounding the location where the cutting bit holding element was removed; however, surface 38 remains undisturbed. Thus, a new cutting bit holding element can be inserted with the full assurance that the correct positioning and alignment of the replacement cutting bit holding element will be maintained through the cooperation of the recess bottom surface 38 and niche 42 with the new cutting bit holding element bottom surface 20 and alignment feature 22. Once such features have been cooperatively engaged, the replacement cutting assembly can then be secured in that proper position by a reapplication of a peripheral weld line 44 which again acts to continue to protect the reference surface 38 and alignment niche 42.

Another cutting assembly 31, in accordance with the present invention, is shown in FIG. 5 and includes a driven member 32 having an outer surface 34 which is rotatable in a cutting direction, arrow A. The driven member 32 includes a plurality of recesses 36, two of which are shown receiving discrete support elements 52. The discrete support elements 52 are inserted between the drum surface 34 and the cutting bit holding elements 10. The cutting bit holding element 10 similar to that shown in FIGS. 1–3 includes a replaceable cutting bit 50. Each recess 36 includes a bottom reference surface 39, shown to be conical in two instances, which is depressed below the driven member rotatable surface 34. The bottom reference surface 39 of each recess 36 and the lower end surface 54 of the discrete support element 52 are preferably complementary to maximize surface contact when the discrete support element 52 lower end surface 34 is situated in abutting relationship with the recess bottom reference surface 39. While the surfaces 20 and 39 are illustrated variously to be planar and conical, the surfaces could also be spherical or some other shape symmetric with respect to axis R. Each recess 36 also includes a generally circular upper edge 40 and a niche 42 shown located in bottom surface 39 to receive the locating element 22. It will be appreciated that the niche 42 should be complementary to the locating element 22 to uniquely position and align the lower end surface 54 of the discrete support element 52 bottom portion within the recess 36. The location of the niche 42 in the bottom surface 39 determines the alignment of the discrete support element 52 with respect to the cutting direction, arrow A. The pattern and arrangement of the support elements 52 is subject to variation, but in a preferred embodiment the pattern follows my co-pending U.S. patent application Ser. No. 08/805,145 filed Feb. 24, 1997, is which case each of the support elements 52 constitute flighting segments weldable together to form a substantially continuous flighting.

Each of the support elements 52 have an outer end surface 56 including a recess 58 receiving a cutting bit holding element 10 which is situated within the recesses 58, oriented by means of locating pin 60 being received in niche 62, as shown in FIG. 5, and secured in position by means of a weld line 64 joining the cutting bit holding element 10 to the outer end surface 56 along a line outside of the upper edge 40 of each recess 58. Thus while the cutting assembly is in use mining the roadway or other surface, the bottom reference surface 39 of recess 36 and the bottom reference surface 37 of the outer end recess 58 are both protected from abrasion or wear. In the event of wear or catastrophic failure of one or more of the cutting bit holding elements 10, or in the rare event of catastrophic failure of a portion of one or more flighting segments 52, the worn or failed element can be removed from the assembly usually by removing the old weld line to reveal the outer surface, installing a new element similar to that removed so that the recessed bottom reference surfaces are in abutting relation with an appropriate locating element engaged in each niche, and securing the elements in place by welding so that the correct positioning and alignment of the replacement cutting bit holding element will be maintained.

Although the invention has been described in detail with reference to the illustrated preferred embodiment, variations and modifications exist within the scope and spirit of the invention as described and as claimed in the following claims.

What is claimed is:

1. A cutting assembly for use in a roadway surface reclaiming machine, the cutting assembly comprising:

a driven member having a surface rotatable in a cutting direction, a plurality of recesses arranged in a preselected pattern over the driven member surface, each recess being defined by a generally circular upper edge and including a bottom surface depressed below the driven member rotatable surface, an array of cutting bit holding elements, each cutting bit holding element having a lower end received in only one of the recesses with the lower end abutting the recess bottom surface, and each cutting bit holding element having an edge proximal to the recess circular upper edge, a locating element engaged between each recess and the cutting bit holder element situated therein for orienting the holder element with respect to said cutting direction, and securing means securing each cutting bit holding element to the driven member surface.

2. A cutting assembly of claim 1 wherein said cutting bit holder element edge proximal to the recess circular upper edge includes a flange projecting outwardly to cover the recess circular upper edge.

3. A cutting assembly of claim 1 wherein each said recess bottom surface is planar and includes a niche for receiving said locating element.

4. A cutting assembly of claim 3 wherein the locating element is situated at a uniform position in all the cutting bit holding elements, the niche being located at various positions within each recess to align the cutting bit holding elements at desired orientations with respect to said cutting direction.

5. A cutting assembly of claim 1 wherein each cutting bit holding element includes a single aperture for receiving a cutting bit.

6. A cutting assembly of claim 1 wherein the locating element comprises a pin projecting downwardly from the cutting bit holding element lower end.

7. A cutting assembly of claim 1 wherein the lower end of each cutting bit holding element comprises a right cylinder having a diameter closely approximating the diameter of the plurality of recesses.

8. A cutting assembly of claim 1 wherein the securing means comprises at least one weld joining said edge proximal to the recess circular upper edge to the driven member surface.

9. A cutting bit holding element for removably receiving a cutting bit to be secured to a cutting assembly in a roadway surface reclaiming machine, the cutting assembly comprising a driven member having a surface rotatable in a cutting direction including a plurality of recesses arranged in a preselected pattern, each recess being defined by a generally circular upper edge and including a bottom surface depressed below the driven member rotatable surface, each cutting bit holding element comprising:

a body having a lower portion sized to be received in only one of said recesses including a lower end for abutting said recess bottom surface, at least one aperture in the body for receiving a cutting bit, a separate locating element engaging the cutting bit holder element lower portion for orienting the cutting bit holder with respect to said cutting direction, and an edge sized to be proximal to the recess circular upper edge to permit fixed attachment of the body to the driven member rotatable surface.

10. A cutting bit holding element of claim 9 wherein said edge sized to be proximal to the recess circular upper edge includes a flange projecting outwardly to cover said recess circular upper edge.

11. A cutting bit holding element of claim 9 wherein said at least one aperture comprises a single aperture for receiving a single cutting bit.

12. A cutting bit holding element of claim 9 wherein the locating element comprises a pin projecting downwardly from the cutting bit holding element lower end.

13. A cutting bit holding element of claim 9 wherein the lower portion comprises a right cylinder having a planar lower end surface.

14. A cutting bit holding element for removably receiving a cutting bit to be secured to a cutting assembly in a roadway surface reclaiming machine, the cutting assembly comprising a driven member having a surface rotatable in a cutting direction including a plurality of recesses arranged in a preselected pattern, each recess being defined by a generally circular upper edge and including a bottom surface depressed below the driven member rotatable surface, each cutting bit holding element comprising:

a body portion including a lower portion having a generally cylindrical outer surface sized to be received in only one of said recesses, the lower portion having a reference lower end complementary to said recess bottom surface, a separate locating element engaging the cutting bit holder element lower end to engage a feature within said recess for orienting the cutting bit holder with respect to said cutting direction, and an edge sized to be proximal to the recess circular upper edge to permit fixed attachment of the body portion to the driven member rotatable surface.

15. A cutting bit holding element of claim 14 wherein said edge sized to be proximal to the recess circular upper edge includes a flange projecting outwardly to extend beyond and cover said recess circular upper edge.

16. A cutting bit holding element of claim 14 wherein said body portion includes at least one aperture for receiving a cutting bit.

17. A cutting bit holding element of claim 16 wherein said at least one aperture comprises a single aperture for receiving a single cutting bit.

18. A cutting bit holding element of claim 14 wherein the locating element comprises a dowel pin projecting downwardly from the reference lower end to engage a niche within said recess.

19. A cutting bit holding element of claim 14 wherein the reference lower end comprises a planar end surface perpendicular to the generally cylindrical outer surface of the cutting bit holding element lower portion.

20. A cutting bit holding element of claim 14 wherein the body portion includes an outer surface having a single recess defined by a generally circular upper edge and including a bottom reference surface depressed below the outer surface.

21. A cutting assembly for use in a roadway surface reclaiming machine, the cutting assembly comprising:

a driven member having a cylindrical surface rotatable in a cutting direction, a plurality of descrete support elements constituting flighting segments fixed to the driven member sylindrical surface and joined together to form a substantially flighting, each descrete support including an outer surface having a recess defined by a generally circular upper edge and including a bottom reference surface depressed below the descrete support element outer surface, an array of cutting bit holding elements, each cutting bit holding element having a lower end received in only one of the recesses with the lower end being complementary to, and situated to abut, the recess bottom reference surface, and each cutting bit holding element having an edge proximal to the recess circular upper edge, a locating element engaged between a niche within each recess and the cutting bit holder element situated therein for orienting the holder element with respect to said cutting direction, and securing means securing each cutting bit holding element to the descrete support element at a location spaced from the abutting lower end and recess surfaces so that, upon replacement of the cutting bit holding element through severing of the securing means, the reference surface and locating element receiving niche remain undisturbed to ensure proper alignment of a similar replacement structure.

22. A cutting assembly of claim 21 wherein each of the cutting bit holding elements includes a flange projecting outwardly to extend beyond and cover said recess circular upper edge, and a planar end surface perpendicular to the generally cylindrical outer surface of the cutting bit holding element lower portion.

23. A cutting assembly of claim 21 wherein said driven member cylindrical surface includes a plurality of recesses arranged in a preselected pattern over the driven member surface, each recess being defined by a generally circular upper edge and including a bottom surface depressed below the driven member rotatable surface, each of said descrete support elements comprises a lower end received in only one of the recesses with the lower end abutting the recess bottom surface, and each descrete support element having an edge proximal to the driven member recess circular upper edge, and a locating element is engaged between each recess and the descrete support element situated therein for orienting the holder element with respect to said cutting direction.

24. A cutting assembly for use in a roadway surface reclaiming machine, the cutting assembly comprising:

a driven member having a surface rotatable in a cutting direction, a plurality of recesses arranged in a preselected pattern over the driven member surface, each recess being defined by a generally circular upper edge, including a bottom surface depressed below the driven member rotatable surface, said bottom surface further comprising an indented niche, an array of cutting bit holding elements, each cutting bit holding element having a lower end received in only one of the recesses with the lower end having an interior niche abutting the indented niche in the recess bottom surface, and each cutting bit holding element having an edge proximal to the recess circular upper edge, a separate locating element engaged between the indented niche of each recess and the interior niche of the cutting bit holder, said separate locating element situated therein for orienting the holder element with respect to said cutting direction, and for preserving the condition of the interior niche and indented niche during failure events and repair activities, and securing means securing each cutting bit holding element to the driven member surface.

* * * * *